United States Patent [19]

Moellers

[11] Patent Number: 4,774,942

[45] Date of Patent: Oct. 4, 1988

[54] BALANCED EXHALATION VALVE FOR USE IN A CLOSED LOOP BREATHING SYSTEM

[75] Inventor: Chris M. Moellers, Davenport, Iowa

[73] Assignee: Litton Systems, Inc., Davenport, Iowa

[21] Appl. No.: 90,554

[22] Filed: Aug. 28, 1987

[51] Int. Cl.[4] ..... A62B 9/02

[52] U.S. Cl. ..... 128/205.24; 128/205.12; 128/205.28

[58] Field of Search ..... 128/205.24, 205.12, 128/204.18, 205.13, 205.17, 201.25, 201.28, 205.27, 205.28; 137/494

[56] References Cited

U.S. PATENT DOCUMENTS

| | | | |
|---|---|---|---|
| 4,186,735 | 2/1980 | Henneman et al. | 128/204.26 |
| 4,299,216 | 11/1981 | Bernard et al. | 128/205.12 |
| 4,498,470 | 2/1985 | Warncke | 128/205.12 |
| 4,606,340 | 8/1986 | Ansite | 128/205.24 |
| 4,640,277 | 2/1987 | Meyer et al. | 128/205.24 |

FOREIGN PATENT DOCUMENTS

| | | | |
|---|---|---|---|
| 799635 | 8/1958 | United Kingdom | 128/205.12 |

*Primary Examiner*—William E. Kamm
*Assistant Examiner*—Timothy G. Philips
*Attorney, Agent, or Firm*—Brian L. Ribando

[57] ABSTRACT

A closed loop breathing system includes a face mask, a pressurized bottle of oxygen-rich breathing gas, and an exhalation hose and an inhalation hose both coupled to the face mask. Flexible breathing bags smoothen the flow of expired gas through the system, and a container of sorbent material removes $CO_2$ from the expired gas. A mixing valve mixes expired breathing gas from the face mask with oxygen-rich breathing gas from the pressurized container. A balanced exhalation valve assembly coupled to the exhalation hose includes a main valve which passes the flow of expired gas from the exhalation hose into a chamber and prevents the reverse flow of gas from the chamber into the exhalation hose. A flexible diaphragm forms one wall of the chamber and is coupled to the main valve by a rigid spacer to prevent a pressure increase in the chamber from increasing the force necessary to open the main valve.

5 Claims, 2 Drawing Sheets

BALANCED EXHALATION VALVE FOR USE IN A CLOSED LOOP BREATHING SYSTEM

This invention relates to a balanced exhalation valve for use in an extended duration closed loop breathing system.

To date, self-contained breathinig systems used by fire and rescue personnel have had certain drawbacks. The closed loop system described in U.S. Pat. No. 4,186,735 issued to John W. Henneman et al and entitled BREATHING APPARATUS performs satisfactorily but provides only a 30-minute breathing supply. Other closed loop systems with a bottled breathing gas supply often have a shorter than rated duration, and deliver an uncomfortable, heated breathing gas supply at less than true positive pressure at the face mask, especially at high work rates. Closed loop systems with a pure oxygen supply are unsuitable for fire fighter use since under certain conditions gas of high oxygen concentration is vented to ambient creating an environment of increased flammibility. Super oxide chemical systems have problems similar to bottled oxygen closed loop systems but with added disadvantages of an unreliable chlorate candle start-up device, questionable stability of super oxide materials (especially when exposed to hydrocarbons), and expensive canisters to replace.

The ultimate breathing system would be an open loop design having reduced weight and volume. Unfortunately, the excessive weight of high pressure bottled gas limits open loop systems to no more than one hour duration. A system which combines the favorable size and weight features of the closed loop design with the breathing characteristics of an open loop design would fulfill all respiratory. requirements in any emergency or rescue environment and provide an optimum breathing system.

SUMMARY AND OBJECTS OF THE INVENTION

According to the invention a closed loop breathing system having a two hour duration operates at all times under a slight positive pressure in the face mask and provides the familiarity in feeling like an open circuit system to the user which is important psychologically. The slight positive pressure is required to avoid the possibility of contamination of the breathing mixture in the face mask. If the pressure in the face mask becomes negative at any time there is a possibility of inward leakage. In a closed loop system any contamination which leaks into the system remains in the breathing loop until the apparatus is removed from the user.

To avoid the discharge of pure oxygen or oxygen rich gas to ambient, a pressurized gas mixture of between 30 and 40 percent oxygen is used. Since only gas which has been exhaled by the user is discharoed to ambient, the oxygen concentration of the discharged gas is always less than that of the pressurized gas mixture.

In order to maintain user fatigue at a minimum, breathing effort using the closed loop system of the invention is nearly identical to that provided by current open loop systems. This desirable characteristic is attributed to a pressure demand breathing regulator and a balanced exhalation valve. The pressure demand breathing regulator incorporates an injector which does the work of circulating the exhaled air through a series of flexible breathing bags and a $C0_2$ scrubber. The balanced exhalation valve prevents the accumulated pressure downstream from the exhalation valve from loading the exhalation valve and provides effortless breathing characteristics.

It is accordingly an object of the invention to provide a closed loop positive pressure breathing apparatus which approximates in feeling the characteristics of an open loop system.

It is another object of the invention to provide a closed loop breathing system in which a balanced exhalation valve prevents the pressure downstream from the valve from loading the valve and increasing the user's breathing effort.

These and other objects of the invention will become apparent from the following detailed description in which reference numerals used throughout the description designate like or corresponding parts shown on the drawing figures.

DESCRIPTION OF THE PREFERRED EMBODIMENT

Figure 1:
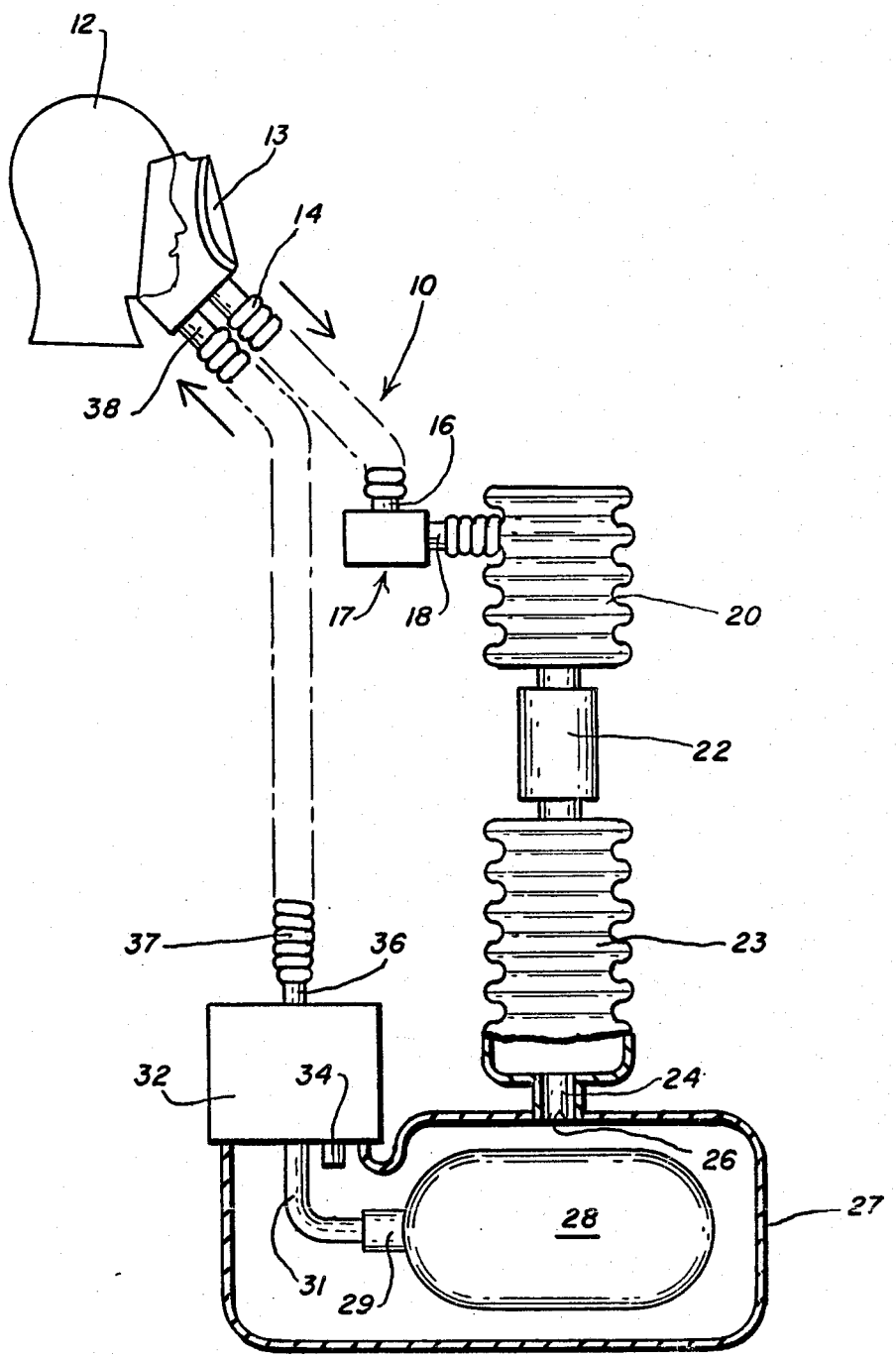
FIG. 1 is a schematic view of a closed loop breathing system.

Turning now to the drawing figures, Figure 1 shows a close loop breathing apparatus generally designated by the reference numeral 10. The breathing apparatus is employed by a user 12 by means of a face mask 13 which allows breathing through the mouth or nose in the normal way. The mask is coupled by an exhalation hose 14 to the inlet 16 of a balanced exhalation valve assembly 17. The outlet 18 of the exhalation valve is coupled to a first flexible breathing bag 20, and the flexible breathing bag 20 is coupled to a container 22 of a carbon dioxide sorbent material such as sodalime. The sorbent container 22 is coupled to a second flexible breathing bag 23 having an outlet 24. The outlet 24 of the second flexible breathing bag 23 is coupled to the inlet 26 of a flexible heat exchange bag 27. Contained within the heat exchange bag 27 is pressurized bottle 28 of oxygen-rich gas comprising a mixture of between 30 and 40 percent oxygen. The outlet 29 of the bottle 28 is coupled to the high pressure gas inlet 31 of a gas mixing and regulator valve 32. The outlet of the flexible heat exchanger bag 27 is coupled &o the low pressure gas inlet 34 of the gas mixing and regulator valve 32. The outlet 36 of the gas mixing and regulator valve 32 is coupled to an inhalation hose 37 the other end of which is coupled to the inlet port 38 of the face mask 13.

Figure 2:
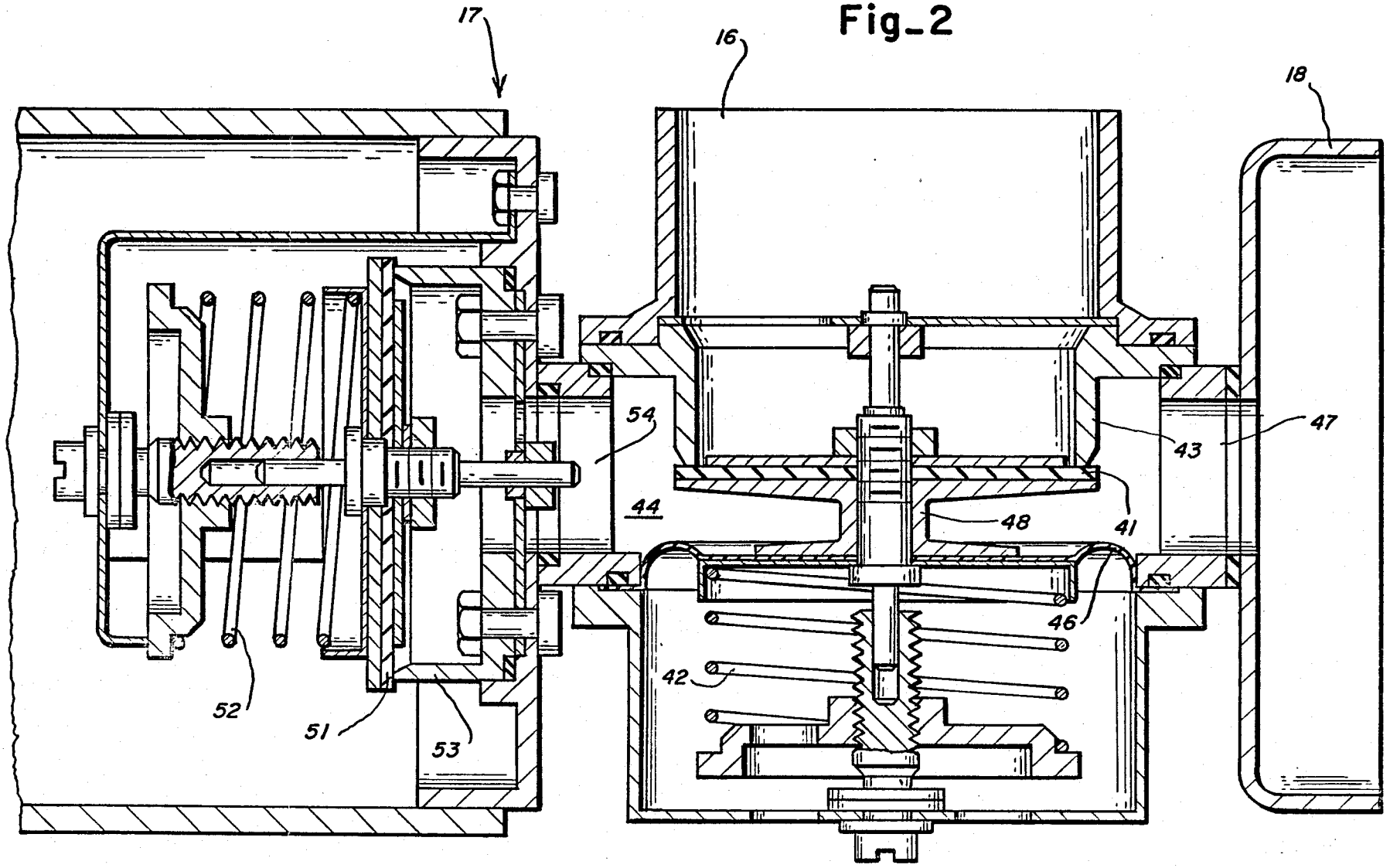
FIG. 2 is a sectional view of the exhalation valve used in the closed loop breathing system of FIG. 1.

Turning now to FIG. 2, the balanced exhalation valve assembly 17 is shown in greater detail. The valve assembly 17 comprises a main valve 41 which is biased by a spring 42 against a seat 43. The valve 41 opens into a chamber 44 one side of which is formed by a flexible diaphragm 46. The flexible diaphragm 46 and the main valve 41 are attached to a rigid spacer 48 and move in unison. The chamber 44 includes an outlet port 47 which communicates with the outlet 18 of the valve assembly 17. The valve assembly 17 also includes a relief valve 51 which is biased by a spring 52 against a seat 53. The relief valve assembly is in communication with the gas in the chamber 44 by means of a relief port 54.

MODE AND OPERATION OF THE PREFERRED EMBODIMENT

In order to use the device, the user 12 breathes normally into the mask 13. Expired gases from the user 12 are coupled by the exhalation hose 14 to the inlet 16 of the balanced exhalation valve assembly 17. The pressure of the expired gas in the inlet 16 opens the main valve 41 to allow the expired gas to enter the chamber 44. The spring 42 opposes the opening of the valve 41 to provide a slight positive breathing pressure to the user and to close the valve 41 for preventing the reverse flow of expired gases through the valve. The gas from the chamber 44 passes through the port 47 and through the outlet 18 of the exhalation valve 17. Gas from the outlet 18 enters the first flexible breathing bag 20 which expands and contracts to accommodate the gas flowing therethrough and acts as an accumulator to smoothen the gas flow. The first flexible breathing bag 20 is coupled to the container 22 of sodalime sorbent which removes $C0_2$ from the exhaled gas and delivers the scrubbed gas to a second flexible breathing bag 23 which further smoothens gas flow through the device. The second flexible breathing bag 23 is coupled to a flexible heat exchange bag 27 which brings the gas into contact with the pressurized bottle 28 of oxygen-rich gas.

The gas mixing and regulator valve 32 in response to suction applied to the inlet hose 37 from the mask 13 admits high pressure gas from the bottle 28 into high pressure gas inlet 31 of the regulator 32. The release of high pressure gas from the pressurized bottle 28 cools the bottle 28 and the gas which is in the heat exchanger bag 27. Further, high pressure gas applied to the inlet 31 enters an expansion chamber (not shown) in the valve 32 which lowers the pressure and creates a suction at the low pressure gas inlet 34 to draw the low pressure oxygen-poor gas from the heat exchange bag 27 into the gas mixing and regulator valve 32 where it is mixed with the high pressure gas from the bottle 28. The gas mixing and regulator valve 32 is more fully described in the aforementioned Henneman et al patent. The mixed high pressure gas and the low pressure gas is delivered to the user 12 through the inhalation hose 37 to the inlet port 38 of the mask 13.

During the exhalation cycle of the user, there is no suction demand on the gas mixing and regulator valve 32 to draw the oxygen-poor exhaled gas through the breathing bags 20 and 23 and the container 22 of $C0_2$ sorbent material. Accordingly, a buildup of pressure on the exhalation side of the device results in increased pressure in the chamber 44 which opposes the opening of the main valve 41 and increases the breathing effort required by the user. In order to avoid this result, the chamber 44 in which the exhalation valve 41 is located includes the flexible diaphragm 46 which is subjected to the same increased pressure as the main valve 41. Thus, increased pressure in the chamber 44 causes a force on the diaphragm 46 which is transferred to the main valve 41 by the rigid spacer 48. The force of the spring 42 and the relative sizes of the valve 41 and the diaphraom 46 are chosen so that the valve 41 will open between ½ and 2 inches of water column pressure applied to the valve 41 at the inlet 16 regardless of the pressure in the chamber 44.

The relief valve 51 is set to open to prevent overpressurizing of the chamber 44; and in actual practice, the relief valve opens at 2 inches of water column pressure. Since the gas in the chamber 44 is a mixture of the pressurized gas in the bottle 28 comprising 30 to 40 percent oxygen and the oxygen-poor gas which has been expired from the face mask 13, the oxygen concentration of gas which is vented by the relief valve is less than that of the gas inhaled by the user which is mixed to an oxygen concentration between 19.5% and 30%. Thus, the release of this gas by the relief valve into the immediate environment does not create a flammibility problem.

Having thus described the invention, various alterations and modifications will occur to those skilled in the art, which modifications and alterations are intended to be within the scope of the invention as defined by the appended claims.

What is claimed is:

1. A closed loop breathing system comprising:

a face mask;

a pressurized bottle of oxygen-rich breathing gas;

an exhalation hose and an inhalation hose coupled to the face mask;

means for smoothing the flow of expired gas through the system;

scrubbing means for removing $CO_2$ from the expired gas;

means for mixing expired breathing gas from the face mask with oxygen-rich breathing gas from the pressurized bottle; and an exhalation valve assembly coupled to the exhalation hose, said exhalation valve assembly comprising a main valve for passing the flow of expired gas from the exhalation hose into a chamber and for preventing the reverse flow of gas from the chamber into the exhalation hose, and balancing means for preventing a pressure increase in the chamber from increasing the force necessary to open the main valve.

2. The closed loop breathing system of claim 1 wherein the balancing means comprises a flexible diaphragm, and the flexible diaphragm comprises one wall of the chamber.

3. The closed loop breathing system of claim 2 further comprising:

a rigid spacer between the main valve and the flexible diaphragm, whereby the force on the flexible diaphragm resulting from the pressure in the chamber is applied to the main valve.

4. The closed loop breathing system of claim 3, further comprising:

a relief valve coupled to the chamber, whereby the pressure in the chamber is limited to the pressure rating of the

5. The closed loop breathing system of claim 1 further comprising:

a relief valve coupled to the chamber, whereby excess pressure in the chamber may be vented to ambient, and wherein the oxygen content of the expired breathing gas in the chamber is less than the oxygen-rich breathing gas from the pressurized bottle.

* * * * *